United States Patent [19]

Barlow

[11] 4,334,841

[45] Jun. 15, 1982

[54] MECHANICAL DEVICES FORMING AN ENGINE

[76] Inventor: Henry A. Barlow, 1189 Guildwood Blvd., London, Ontario, Canada

[21] Appl. No.: 26,241

[22] Filed: Apr. 2, 1979

[51] Int. Cl.[3] ..... F01C 1/067; F01C 21/04

[52] U.S. Cl. ..... 418/38; 418/94

[58] Field of Search ..... 418/38, 91, 94; 123/245; 74/665 B

[56] References Cited

U.S. PATENT DOCUMENTS

| | | | |
|---|---|---|---|
| 1,330,629 | 2/1920 | Gooding | 418/38 |
| 1,568,053 | 1/1926 | Bullington | 123/245 |
| 1,962,408 | 6/1934 | Powell | 418/38 |
| 2,260,009 | 10/1941 | Doran et al. | 74/665 B |
| 2,271,068 | 1/1942 | Gardner | 418/38 |
| 2,362,550 | 11/1944 | Hansen | 418/94 |
| 2,450,150 | 9/1948 | McCulloch et al. | 418/94 |
| 3,292,602 | 12/1966 | Stewart | 418/94 |
| 3,299,865 | 1/1967 | Moyer | 418/38 |
| 3,500,798 | 3/1970 | Arnal | 418/38 |

FOREIGN PATENT DOCUMENTS

| | | | |
|---|---|---|---|
| 12560 | of 1912 | United Kingdom | 123/245 |
| 267565 | 9/1927 | United Kingdom | 418/38 |
| 278648 | 3/1928 | United Kingdom | 418/38 |

*Primary Examiner*—John J. Vrablik

[57] ABSTRACT

The invention provides the mechanism for an internal combustion engine that utilizes a radial flow of combustible gases about the axis of a toroid or annulus cylinder. The principal components consist of a rhomboid linkage mechanism operating within a stationary cam. The mechanism sustains torque from two coaxial drive shafts upon which the mechanism imposes a compound rotary motion whereby an angular harmonic is superimposed over a constant angular velocity. This motion is applied through discs to two pair of pistons within the cylinder to effect a radial flow with a precisely defined theoretical cycle. Where the mechanics are used for a radial flow engine, the power generated is taken from the rhomboid mechanisms by a coupling and final drive shaft.

Further the invention includes within its scope a method by which the discs are self sealing and the means of producing a multicylinder unit.

1 Claim, 18 Drawing Figures

MECHANICAL DEVICES FORMING AN ENGINE

The invention relates to the mechanics of an internal combustion engine that derives its power from the radial flow of gases about the axis of an annulus or toroid cylinder. Further, it is an improvement of previous designs disclosing engines of similar form.

The principal intent of the invention is to implement a precisely defined theoretical gas cycle within a toroid cylinder and by that implementation permit the manufacture of an engine with higher power to weight and power to volume ratio than is reasonably possible with a reciprocating engine.

Although a radial flow engine has theoretical efficiency limitations similar to those imposed on reciprocating engines, the cold wall compression and hot wall expansion of gases to be described in this disclosure, together with reduction of both the resistance to gas flow and internal losses within the engine, will lead to greater efficiency. It will also be seen that the engine of this invention closely approximates a turbine in that there is virtually no change of internal momentum during the rotation of the engine and the need for a flywheel is essentially eliminated.

Drawings used to illustrate the embodiment of the invention are

FIGS. 1 to 6—The theoretical gas cycle. The figures illustrate the gas cycle during one-half (½) a revolution of the engine.

Figure 7:
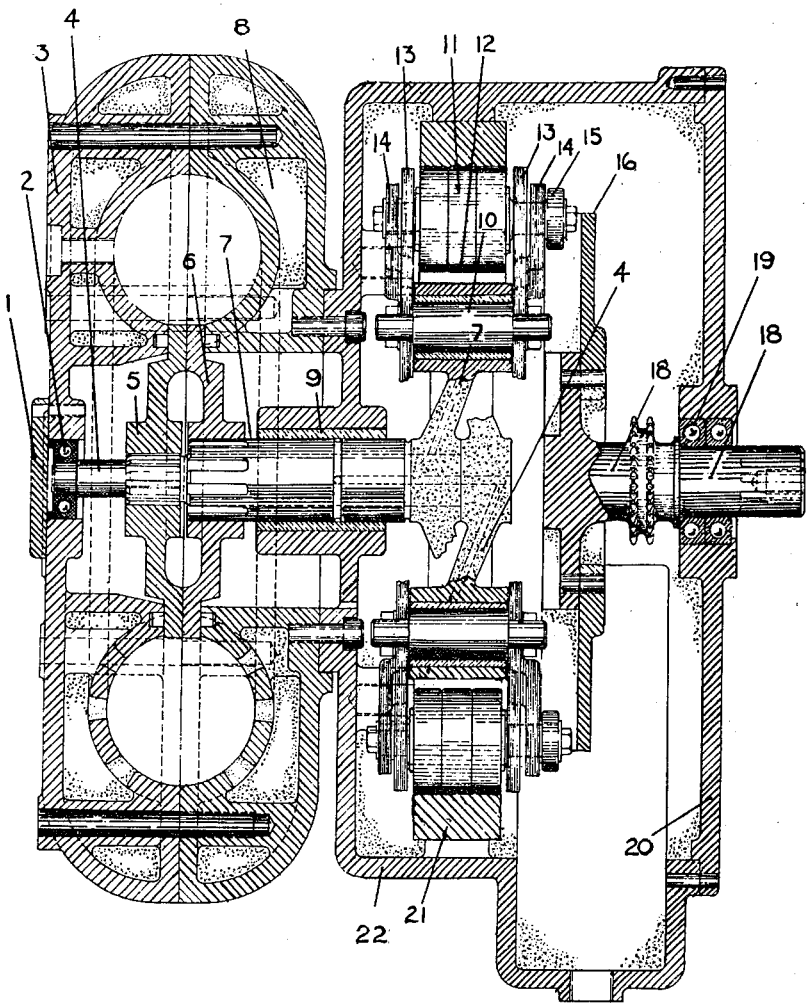

FIG. 7—A cross section along the axis of a typical radial gas flow engine of this invention.

Figure 8:
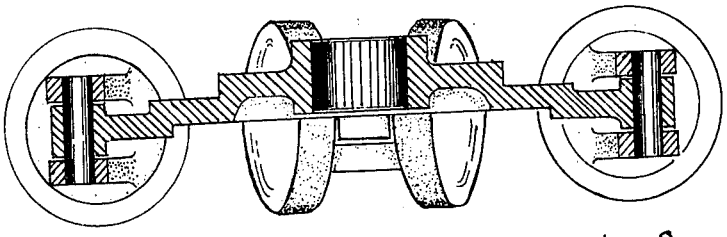

FIG. 8—Shows a sectional driving disc assembly with connection arms centralized to the piston.

Figure 9:
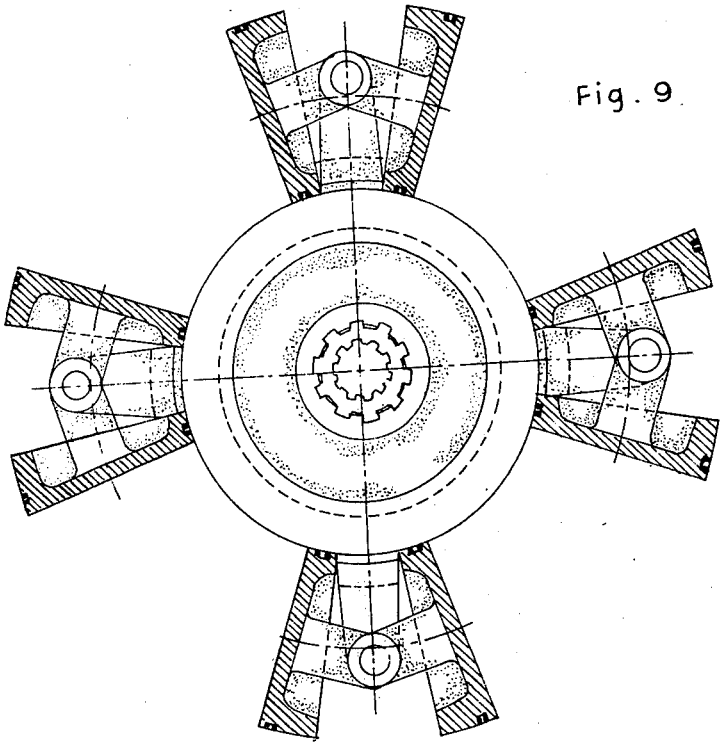

FIG. 9—Shows a section of four (4) pistons, two (2) being connected to the forward driving disc and two (2) being connected to the rear driving disc.

Figure 10:
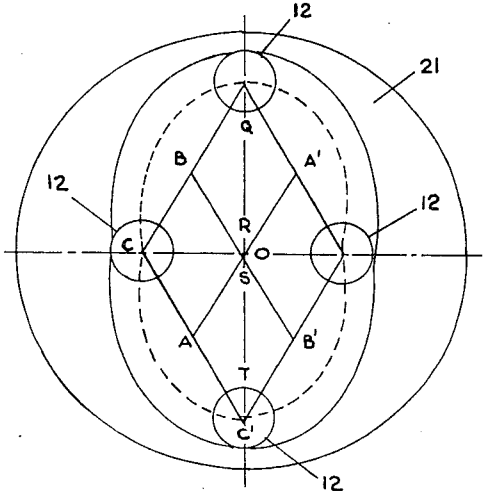

FIG. 10—Illustrates the geometry of the rhomboid mechanism.

Figure 11:
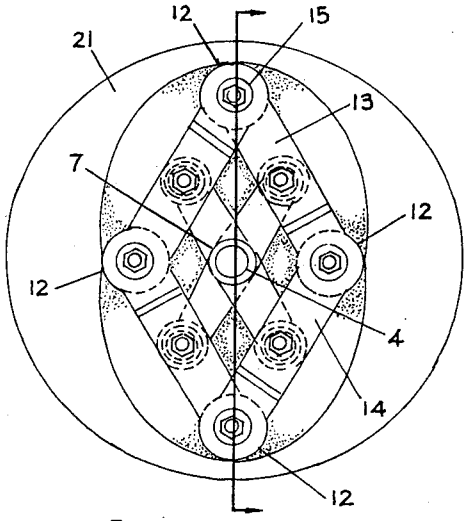

FIG. 11—Shows the cam, rollers and the rhomboid linkage.

Figure 12:
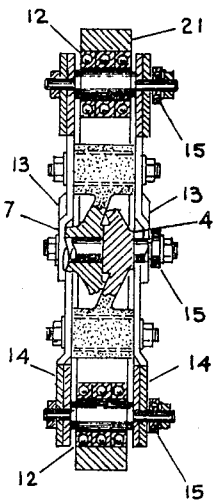

FIG. 12—Shows a section through the line 12—12 of FIG. 11.

Figure 13:
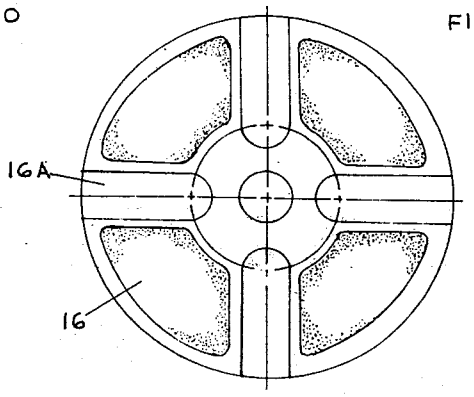

FIG. 13—Illustrates a frontal view of a power take-off coupling.

Figure 14:
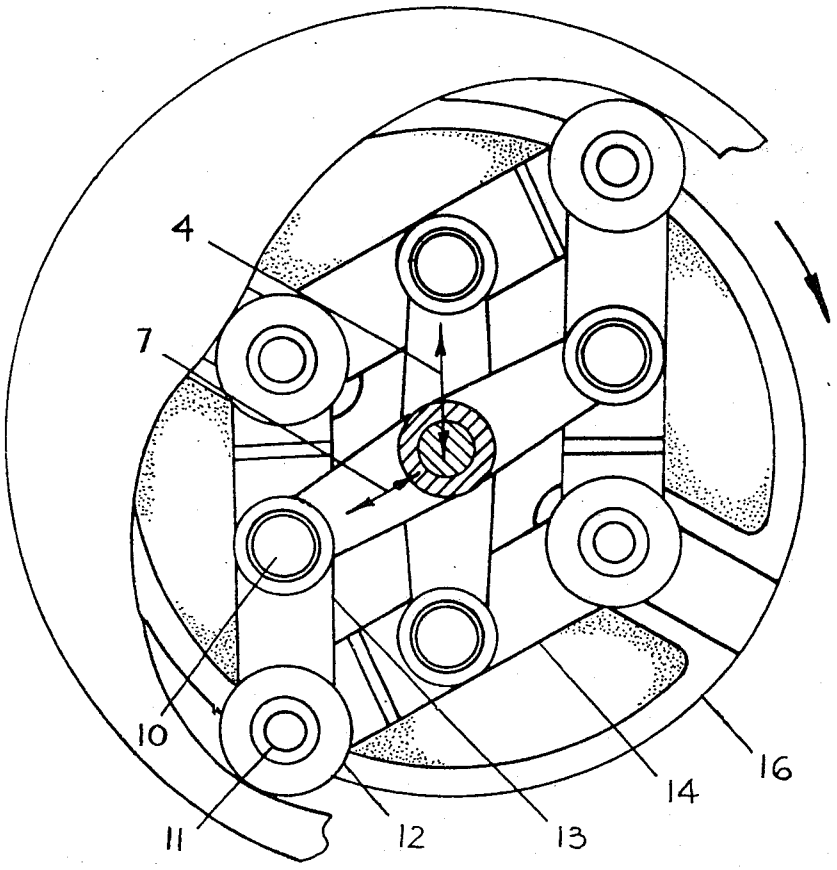

FIG. 14—Illustrates the rhomboid mechanism with cam rollers bearing to the cam and the power take-off coupling immediately behind the linkage and cam.

Figure 15:
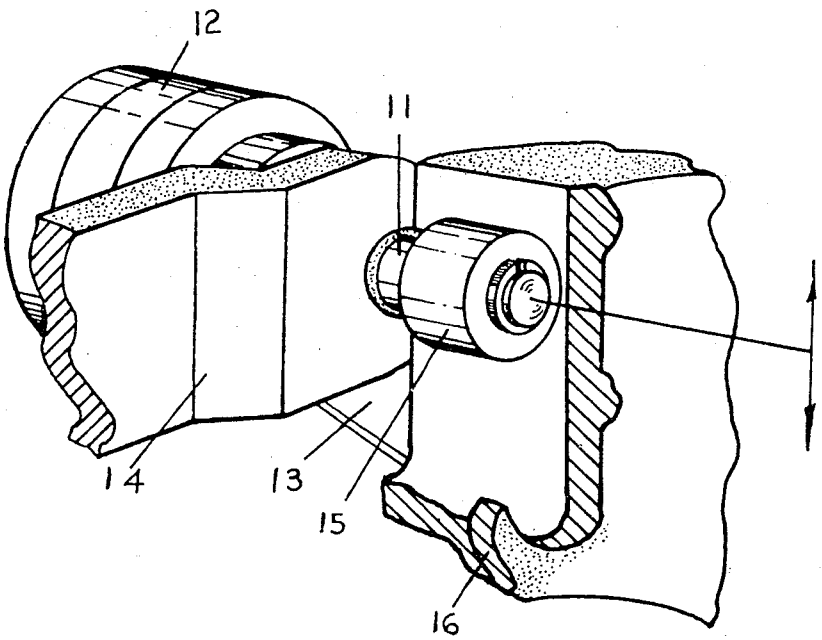

FIG. 15—Illustrates the interaction between the rhomboid linkage and the power take-off coupling, with a cut-away isometric drawing.

Figure 16:
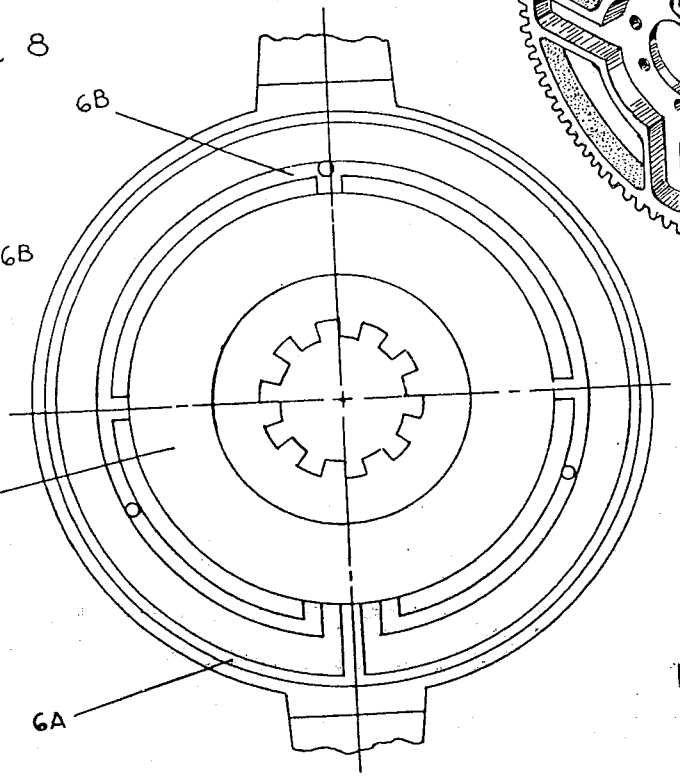

FIG. 16—Shows the mating face of the rear driving disc with the combination of pressure relief and lubrication return channel.

Figure 17:
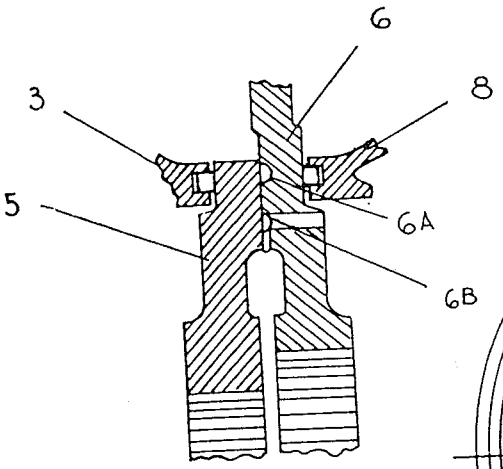

FIG. 17—Shows a cut-away section of the driving discs. It displays in part the multiple channel system with lubricant return hole cut through the disc.

Figure 18:
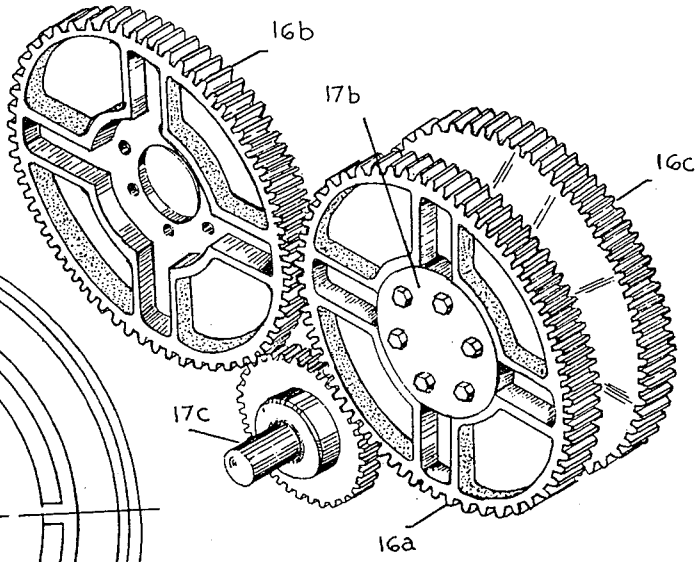

FIG. 18—Illustrates the disposition of power take-off couplings in a multi-power unit engine.

As stated, the invention of this engine is primarily based on a precisely defined mechanical cycle. The theoretical cycle is here disclosed immediately.

A stationary toroid cylinder or cylinder of similar form shall have suitably placed within its walls an intake port, an exhaust port and the means of ignition and, or fuel injection.

Figure 1:
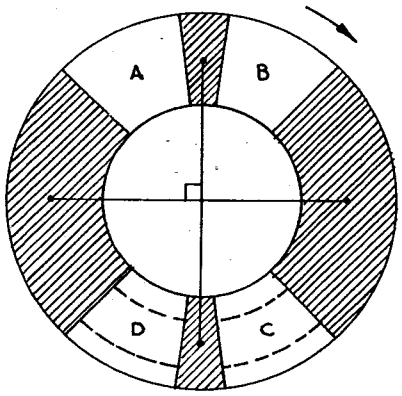

Within the cavity of the cylinder there will be four movable partitions called pistons that effectively seal one part of the cylinder cavity from any other. Thus the single cylinder cavity is separated by the pistons into four cylinder interspaces; the centroids of all four interspaces will have the relationship that a line from one centroid to its opposite centroid will pass through the central axis of the cylinder and the two lines thus formed will be mutually perpendicular to each other. The relationship of the centroids is illustrated in FIG. 1 which also shows pistons A, B, C and D with piston D covering an intake port and piston C covering an exhaust port within the cylinder wall as previously stated.

Figure 2:
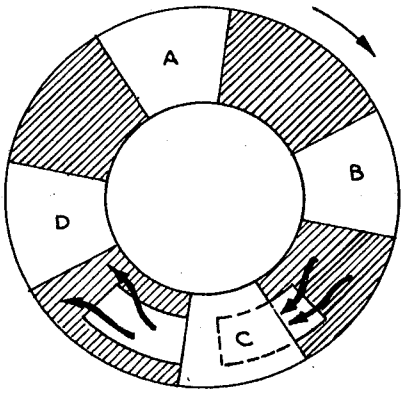
Figure 3:
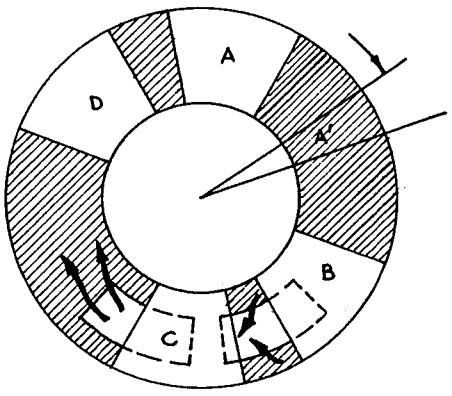
Figure 4:
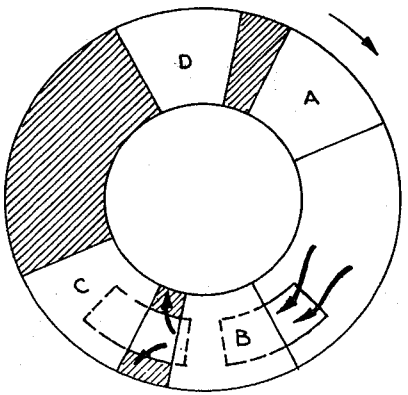
Figure 5:
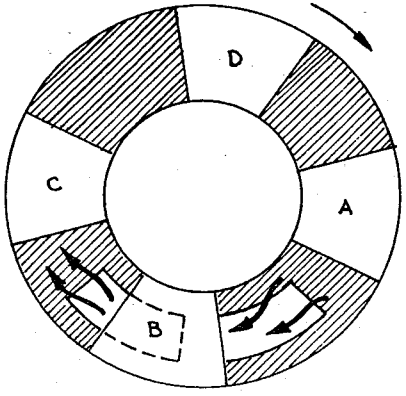
Figure 6:
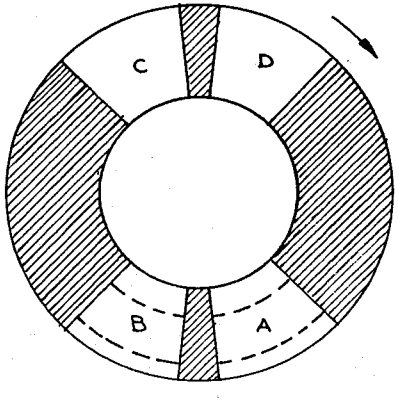

The centroids of the four interspaces will be caused to rotate about the central axis. Their fixed relationship is in no way effected by this rotation. The rotation will cause a variation in the volume of the interspaces in the following manner. Where the four centroids coincide with four stationary points within the cylinder the volume of the interspaces will be equal. This position is illustrated in FIG. 2 and FIG. 5. Given these neutral positions the volume of the interspaces will be determined by the relationship illustrated in FIG. 3 where the angle A′ is the angle of displacement of the controid to a neutral datum line (D′-D″).

The volume of the interspace is equivalenced by the formula $VS = VN + K * \text{Func } A'$, where VS represents the interspace volume, VN represents the volume at a neutral position, K is a constant, Func. is an angular harmonic function with a period of one half revolution and A′ is the angular measure previously stated.

Thus, the rotation of the centroids about the axis of the cylinder will cause a radial flow of gases about the said axis. This radial flow is illustrated by FIG. 1 through to FIG. 6 which, when taken consecutively, illustrates one half revolution of the cycle. It will be seen that there is the equivalence of four working cycles for each revolution of the engine. Each of the four interspaces passing through the four stages of a working cycle for each revolution of the engine. It is noteworthy that compression occurs where the cylinder walls have not been exposed to hot gases, and expansion occurs where the walls have been exposed to hot gases.

The manner in which the invention gives practical effect to the radial flow is now disclosed.

The engine will have a cylinder unit as previously described with the additional features that provision will be made within the walls for the intrusion of forward and rear driving discs. These discs will be seen as items 5 and 6 of FIG. 7. There will also be provision within the cylinder unit for necessary bearing supports and a coolant jacket or other suitable means of heat dissipation. Provision for a bearing support is shown as item 2 of FIG. 7 whilst a coolant jacket can be seen included in the forward and rear half cylinders, items 3 and 8 of FIG. 7. To give practical effect to the manufacture of the cylinder unit it would be necessary to produce it in several sections as illustrated in FIG. 7 where two sections are used to produce the toroid form as an integral unit.

Within the cylinder cavity, four pistons, together with their seals will be housed. A pair of pistons will be firmly connected diametrically opposite to each other to the forward driving disc, whilst a second pair of pistons are similarly connected to the rear driving disc.

It is known that the discs cannot simultaneously be centred to lie within a plane that bisects the cylinder cavity and therefore a twisting action will occur and must be restrained by the discs. One manner in which the present invention is intended to be an improvement over previous designs is the manner in which the pistons and discs are integrated into a unit. It is desirable to keep the pistons as light in structural form as possible and therefore the loading should at all times be centred to that structure. To achieve this, arms extend out from the discs to within the cavity of the piston. These arms are not restrained by the adjacent disc and are therefore centred to the piston where they are connected. The basis of this design is illustrated by items 5 and 23 of FIG. 8 and FIG. 9.

It is not intended by this design to preclude the disc being extended into the piston in the form of a key. As previously stated the discs are subjected to a non-rotational torque during the operation of the engine and their design must restrain this torque without deformation. This invention calls for the integrity of the discs to be maintained by a broad lapping surface between the two discs that excludes a separate seal, whilst at the same time full use is made of cylindrical form to assist in maintaining rigidity. The inner step of item 5 and broad lapping face can be seen in FIG. 9. The maintenance of both a seal and lubrication between the two adjacent disc faces is disclosed later.

To locate, control and give support to this piston assembly, the forward driving disc, item 5, will be keyed or otherwise firmly affixed to an inner drive shaft, item 4 of FIG. 7, and the rear driving disc, item 6, will be similarly affixed to an outer drive shaft, item 7. These coaxial and independently rotatable shafts are shown supported by a forward and centre bearing, items 2 and 9 of FIG. 7. Thus by producing the correct control of the two independently rotatable shafts the radial gas flow cycle previously described can be effected. To effect this motion, the inner and outer drive shafts pass along the axis of the cylinder into a causal mechanism unit in part consisting of a cam and rhomboid mechanism. The casing for this unit is illustrated as item 22 of FIG. 7. Within this unit, the shafts each have pairs of diametrically opposed arms. However, unlike previous designs of engines of this type, these arms are offset in a manner whereby the roller bearing and journal components of the rhomboid mechanism are all placed in line. It is known that a radial flow engine of this invention produces very high rotation torques and the rhomboid mechanism about to be described should not be subjected to a twisting action. This offsetting of the arms and centralized journals are illustrated by items 4, 7 and 10 of FIG. 7 and FIG. 10.

The radial arms thus described are enclosed by eight (8) links, each arm contains a journal pin, supporting at centres its link on either side.

To facilitate an understanding of the rhomboid mechanism reference is made to FIG. 10 where the component parts are represented schematically. The lines A-A′ and B-B′ represent the arms of the inner and outer drive shafts respectively. The line segment C-C′ represents one of the four pairs of links and 0 is the centre of the mechanism.

It would not be amiss to note several of the geometric properties of the rhomboid that are observable in FIG. 10. The line segments A-A′, B-B′ and C-C′ are congruent to each other. A-A′ and B-B′ divide the rhomboid into four congruent rhomboids of half scale. The angles Q, R, S and T are all of equal measure. Any variation in one is accurately interpreted by the others. Further, it is known and easily proven that the diagonals of a rhomboid are mutually perpendicular to each other. Hence C 0 C′ will form a right angle for any disposition of the rhomboid.

The invention requires that the rhomboid mechanism support at the pinned end of the links, four (4) rollers and that these rollers be enclosed by a cam as illustrated in FIG. 10 and FIG. 11.

By causing the mechanism to rotate about its centre the angular relationship between adjacent links will change as directed by the cam through the rollers. The loci of the roller centres are illustrated by a broken line in FIG. 10. In the description of the mechanical cycle, a formula for interspace volume $VS=VN+K*Func\ A'$ was used. This formula may now be restated as $Q=RA+K*Func\ A'$ where Q is an angle as shown in FIG. 10, RA is a right angle, K is a constant product with the harmonic function Func, and A′ is the angle of displacement. The form of the cam can be precisely determined from the above function. Thus the disposition of the pistons within the cylinder is determined by the disposition of the rhomboid mechanism.

It has been noted that the angular relationship of the roller centres with the centre of the mechanism is invariant. Thus by extending the supportive pins additional rollers may be made to fit within slide ways of a power take-off coupling. A power-take-off coupling, item 16, is shown in FIG. 13 with a slideway indicated by 16A.

To better exemplify the cam, rhomboid mechanism and power-take-off coupling the combination of these three units are illustrated in FIG. 14. The forward part of the linkage is removed and part of the cam cut away to reveal more of the coupling. FIG. 15 illustrates more clearly the transfer of torque between the rhomboid mechanism and the power-take-off coupling with an isometric cut-away. A final drive shaft, item 18 of FIG. 7 is firmly fixed to the coupling. Since the inner and outer drive shaft torque is centred within the rhomboid mechanism, the rhomboid mechanism may be used in the manner of a supportive bearing for the forward end of the final drive shaft. This feature of the invention is illustrated in FIG. 7 where the four slideway rollers centre the coupling and hence the final drive shaft. It is worthwhile noting that previous designs of a similar nature required the mutual support of all shaft to resist the twisting action placed on their linkage mechanism.

The invention does not exclude the use of a bearing connection between the final drive shaft and the inner shaft for such purposes as ease of assembly, transfer of lubricants and limiting the loading on the rhomboid mechanism to torque transfer only.

The final drive shaft as shown in FIG. 7 illustrates the means for coupling the power of a single unit engine with provision for auxiliary drive to be taken from the drive shaft.

A study of FIG. 7 will reveal the method by which it is intended to supply lubrication to the moving components. It will be seen that lubrication under pressure applied to the central support bearing, item 9, will by means of oilways cut into and through the inner and outer drive shafts, shown in items 4 and 7, lubricate these shafts and bearings within rhomboid mechanism. It will be realized that escapage between the forward contact surfaces on the inner and outer drive shafts occurs within the space enclosed by forward and rear driving disc, items 4 and 7. The need to maintain a broad lapping face between the driving discs has been disclosed earlier. To achieve this intrinsical feature of the invention two important problems need to be simultaneously resolved, their resolution being within the scope of this invention. By reference to FIG. 17 it will be seen that the area of contact between the discs exceeds the possible area of contact between the cylinder and a disc, thus the intended lapping between the disc faces would be prevented by the combined pressure of gas escaping from the cylinder and excessive lubrication entering the cylinder cavity. The invention calls for a novel set of grooves to be cut into face of one of the driving discs. The first element of the set consists of an annular groove having a pitch diameter approximating the seals shown contained within the cylinder wall of FIG. 17. From this groove, a groove would lead to the inner part of the lapping surface. This pressure relief element can be seen as 6*a* of FIG. 16. The second element of the set consists of an arc groove cut into the disc face of sufficiently smaller diameter as to permit oil from this groove to be returned through the disc to the lubricant reservoir. The arc groove will not be permitted to connect with the first element groove. The complete second element consists of a series of grooves from the arc groove to the inner surface of the disc and a series of holes through disc, from the arc groove. This lubrication metering and return element is shown as 6*b* of FIG. 16. A hole through the disc, item 7, can be seen in FIG. 17.

It will be perceived that for many usages a number of cylinders would be desired. The modification to a multi-cylinder unit is now disclosed. The function of the final drive shaft is changed to an intermediate drive shaft, which retains its relationship to the rhomboid mechanism through a power-take-off coupling as previously described. This intermediate drive shaft gives and receives torque to a central drive shaft through sprockets or other suitable means. This drive arrangement could be most suitably integrated with the power-take-off coupling. The original disclosed engine could then be placed as an engine unit radially and/or laterally about the said central drive shaft, item 17*c*, to give the multi-cylinder engine. Reference to FIG. 18 will show the manner of the above disclosure; where the various units have been stripped away to leave the power-take-off couplings, intermediate drive shafts, item 17*b* , and central drive shafts, item 17*c*. Items 16*a* and 16*b* show two units radially connected whereas items 16*a* and 16*c* show two units laterally connected. The above disclosure should not be interpreted as excluding a single unit having a central drive shaft.

The embodiments of the invention in which an exclusive property or privilege is claimed are defined as follows:

1. A causal mechanism comprising in part three coaxial shafts, said shafts being called inner, outer and a final drive shaft, the outer drive shaft shall partly enclose the inner drive shaft and they shall each at the same end have a pair of radial arms extending outwards, these arms to be offset in such a manner that each pair will be centred to the other and the linkage that will enclose them on either side and to a surrounding stationary cam, the said linkage to consist of eight links of equal length, pivoted at their centres in pairs about each side of the radial arms, further each pair of links will be pivotally joined at the ends to the adjacent pairs of links; these sets of links will also support at their pivotal ends four sets of rollers held firmly by the said links on either side, the said rollers to be held to the enclosing cam; (variously the pairs of links may be integrated into single end wise surrounding units;) the radial arms, links and rollers form the rhomboid mechanism, the angular relationship of the components of the rhomboid mechanism being determined by the said cam, the pivotal ends of the rhomboid mechanism will also support, on one side, drive rollers, the said drive rollers being held outwards from the linkage into the slideways of a power-take-off coupling, the said power-take-off coupling will have mutually perpendicular slideways radiating out from its centre; variously the drive rollers may be replaced by slideblocks, the said power-take-off coupling will be firmly affixed about its centre to the final drive shaft, the said final drive shaft together with the power-take-off coupling is driven by or drives the rhomboid mechanism through the drive rollers, the mechanisms linkage will in turn derive or sustain torque from the combinational effect of opposing and or differing torque of the three drive shafts, together with the regimentation of movement imposed by the stationary cam through the cam rollers; the inner and outer drive shaft extend away from the causal mechanism along the principal axis of a stationary cylinder of toroid or annular form, the said cylinder forming a chamber to enclose four movable partitions or pistons that separate the chamber into four sealed interspaces, the cylinder will have suitably located intake and exhaust ports together with provision for fuel injection and, or ignition of a combustible gas mixture; the cylinder will also have provision for the intrusion of a forward and rear driving disc, the said driving discs are immediately adjacent to each other with the forward and rear driving disc firmly affixed to inner and outer drive shafts respectively; each of the said driving discs will have a pair of diametrically opposed radial arms extended outwards into the cylinder cavity and so formed as to be offset and centred to the cylinder, the arms to pass within hollow pistons, the said pistons will be hollow and attachable to radial arms of the discs in such a manner that the loading to the arms by the pistons will be centred to the cylinder thus avoiding a twisting action of the pistons towards the cylinder walls; the said inner and outer drive shafts will impose, by means of the causal mechanism, to the pistons through the discs a uniform angular motion together with an angular harmonic motion; the rear driving disc shall be modified; the said modification to consist of two elements each of which will be a series of grooves contained within the disc face that laps the forward disc, the first element to be in part a complete annular groove of outer diameter slightly less than the outer diameter of the disc face from this groove a second groove will run into a cavity between the inner part of the forward and rear disc faces; the second element will consist of a groove in the form of an arc, the said arc to be of lesser diameter than the annular groove of the first element, the arc groove will not extend into the second groove of the first element; a series of grooves will extend from the arc groove into the cavity between the two discs, this series of grooves, the arc groove together with one or several holes cut through the disc from the arc grooves, form the second element; the combination of the said elements meet the imperative needs of an engine of this type, the first element preventing a separation of the mating faces of the discs by virtue of pressure between the faces; the said second element distributes lubrication entering the cavity between the disc by escapage between the drive shafts and returns excess amounts to the causal mechanism casing, variously the elements so described may be incorporated into the forward driving disc; this combination of components and mechanism conform to the principal unit of a radial flow internal combustion engine or variously a compressor or pump.

* * * * *